US008002855B2

(12) United States Patent
Köhler et al.

(10) Patent No.: US 8,002,855 B2
(45) Date of Patent: Aug. 23, 2011

(54) UNCOOLED PROTECTIVE SLAG DISCHARGE TUBE

(75) Inventors: Matthias Köhler, Freiberg (DE); Joachim Lamp, Halsbrücke (DE)

(73) Assignee: Siemens Aktiengesellschaft, Munich (DE)

( * ) Notice: Subject to any disclaimer, the term of this patent is extended or adjusted under 35 U.S.C. 154(b) by 353 days.

(21) Appl. No.: 12/217,069

(22) Filed: Jul. 1, 2008

(65) Prior Publication Data

US 2009/0007487 A1 Jan. 8, 2009

(30) Foreign Application Priority Data

Jul. 3, 2007 (DE) ..... 10 2007 030 779

(51) Int. Cl.
*B01J 8/00* (2006.01)

(52) U.S. Cl. ..... 48/127.9; 48/67; 48/202; 48/203; 48/87; 48/61; 48/128; 48/69; 165/119; 165/157; 122/470; 122/7 R

(58) Field of Classification Search ..... 48/67, 202–203, 48/87; 165/119, 157
See application file for complete search history.

(56) References Cited

U.S. PATENT DOCUMENTS

| | | | | |
|---|---|---|---|---|
| 3,341,370 | A * | 9/1967 | Bradley et al. | 148/668 |
| 3,640,704 | A * | 2/1972 | Robertshaw et al. | 420/96 |
| 4,801,330 | A * | 1/1989 | Bose et al. | 75/248 |
| 4,808,197 | A * | 2/1989 | Ayers | 48/69 |
| 2007/0051044 | A1 * | 3/2007 | Holle et al. | 48/210 |

* cited by examiner

*Primary Examiner* — Kaity V. Handal

(57) ABSTRACT

A reactor is proposed for entrained flow gasification for operation with pulverized or liquid fuels, with an externally cooled draft tube protecting the slag discharge outlet. An outlet of the draft tube remains above a water line of a sump of the reactor and is formed from Molybdenum, an alloy featuring molybdenum, Tantalum or an alloy featuring Tantalum.

2 Claims, 1 Drawing Sheet

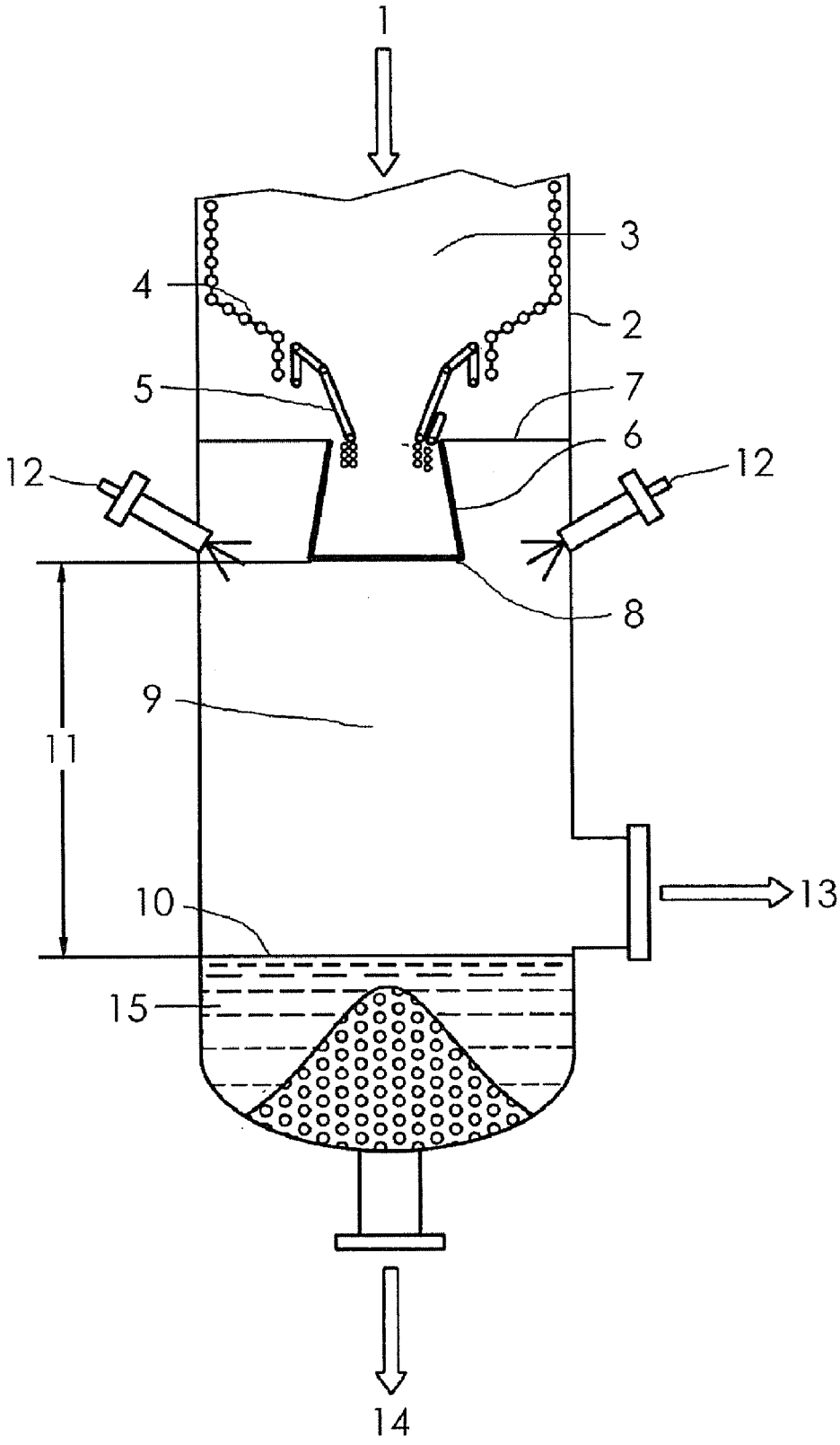
1
3
4
2
5
7
6
12
12
8
9
11
13
10
15
14

UNCOOLED PROTECTIVE SLAG DISCHARGE TUBE

CROSS REFERENCE TO RELATED APPLICATIONS

This application claims the benefits of German application No. 10 2007 030 779.0 filed Jul. 3, 2007 and is incorporated by reference herein in its entirety.

FIELD OF INVENTION

The subject matter of the application relates to a reactor for entrained flow gasification and a draft tube for a reactor for entrained flow gasification.

BACKGROUND OF THE INVENTION

A known embodiment of a reactor for entrained flow gasification has a common reactor outlet for molten slag and the hot crude gas (see FIGURE, reference symbol 5) into the quench chamber. The hot crude gas is rapidly cooled off there by the injection of water. The molten slag simultaneously solidifies and falls into the quench chamber sump. The protective slag discharge tube (also called the draft tube) located at the outlet of the reactor has the task of protecting the slag discharge against direct contact with quench water to prevent the slag solidifying and thereby to prevent a blockage of the reactor discharge outlet. This protective tube is subjected to high thermal stresses and thereby to high levels of wear. In particular when short-duration buildups of slag deposits divert the stream of crude gas heated up to between 1300° C. and 1800° C., damage to this protective tube can result.

The thermal stress on the protective slag discharge tube was previously countered by an intensive cooling down with cooling water. This cooling facility contains the double-wall version of the protective tube, the inclusion of cooling water lines in the quench chamber and the establishment of a cooling water circuit with the corresponding armatures and volume measurement facilities.

SUMMARY OF INVENTION

The problem underlying the invention is that of developing the slag discharge tube such that the cooling lines previously required can be dispensed with.

The problem is resolved by a reactor as claimed in the claims.

Advantageous developments of the subject matter of the application are specified in the subclaims.

By selecting a suitable material, especially Molybdenum or Tantalum, a previously complicated installation can be greatly simplified by the omission of the cooling previously required.

Since any devices built into the quench chamber increase the danger of deposits and buildups, such devices are restricted to those that are absolutely necessary. The omission of the cooling water pipes for the draft tube is a further step for simplification and for increasing the availability of the existing technology.

The choice of Molybdenum as a material enables the cooling of the protective slag discharge tube to be dispensed with. Molybdenum exhibits the necessary form stability up to 1800° C. and resistance to chemicals (in a reducing atmosphere).

As well as Molybdenum there is a plurality of Molybdenum alloys that are more expensive but that have specific advantages over pure Molybdenum (especially resistant to glasses, slag and liquid metals). The Molybdenum-Tungsten used in the glass industry (MoW70—70% by weight Mo, 30% by weight W or MoW50—50% by weight Mo, 50% by weight W) deserves especial mention. Tantalum is suitable as a further temperature-resistant metal because of its better cold workability.

BRIEF DESCRIPTION OF THE DRAWINGS

The sole FIGURE shows a basic diagram of an entrained flow gasifier to the extent required to understand the invention.

DETAILED DESCRIPTION OF THE INVENTION

At the top of the FIGURE, crude gas and slag 1 exit reaction chamber 3 near the top of the reactor 2. The reaction chamber 3 has a bottom 4. A draft tube 6 is in communication with a crude gas and slag discharge outlet 5 of the bottom 4 of the reaction chamber 3. The draft tube 6 is supported by an apparatus 7 attached to reactor 2. The bottom 8 of draft tube 6 is above the water line 10 of the sump 15 by a distance 11. Cooling water is injected via water injection nozzle 12 into the quench chamber 9. The crude gas discharge tube 13 is located above the water line 10 of the sump 15. A discharge tube 14 is located at the bottom of the sump 15.

The invention claimed is:

1. A reactor for entrained flow gasification comprising:

a reaction chamber;

a quench chamber connected via a crude gas and slag discharge outlet to the reaction chamber;

a sump for collection of water and slag at a bottom of the reactor;

an externally cooled draft tube protecting the discharge outlet, wherein an outlet of the draft tube is above a water line of the sump, and the draft tube comprises Molybdenum; and at least one water injection nozzle that injects water into the quench chamber and onto the draft tube to provide external cooling of the draft tube;

wherein the externally cooled draft tube is formed from an alloy comprising at least 50 percent Molybdenum in weight percent.

2. The reactor as claimed in claim 1, wherein the draft tube is not internally cooled by the water.

* * * * *